US009200603B2

(12) United States Patent
Coachman

(10) Patent No.: US 9,200,603 B2
(45) Date of Patent: Dec. 1, 2015

(54) ANTI-SURGE TANK HOUSED WITHIN A FUEL VESSEL

(71) Applicant: Winfield Coachman, Lake Orion, MI (US)

(72) Inventor: Winfield Coachman, Lake Orion, MI (US)

(73) Assignee: Coachman Performance, LLC, Lake Orion, MI (US)

( * ) Notice: Subject to any disclaimer, the term of this patent is extended or adjusted under 35 U.S.C. 154(b) by 371 days.

(21) Appl. No.: 13/764,625

(22) Filed: Feb. 11, 2013

(65) Prior Publication Data

US 2014/0224216 A1 Aug. 14, 2014

(51) Int. Cl.
*F02M 37/10* (2006.01)
*F02D 33/00* (2006.01)

(52) U.S. Cl.
CPC ..... *F02M 37/106* (2013.01); *F02D 33/003* (2013.01)

(58) Field of Classification Search
CPC ..... F02M 37/106; F02D 33/003
USPC ..... 123/446, 457, 510, 511, 514, 522, 523
See application file for complete search history.

(56) References Cited

U.S. PATENT DOCUMENTS

| | | | | |
|---|---|---|---|---|
| 6,113,354 | A * | 9/2000 | Meese et al. | 417/199.1 |
| 6,581,578 | B2 * | 6/2003 | Reiter | 123/516 |
| 2002/0074059 | A1 * | 6/2002 | Schaefer et al. | 141/325 |
| 2004/0052654 | A1 * | 3/2004 | Reinhardt et al. | 417/313 |
| 2004/0211396 | A1 * | 10/2004 | Burhenne et al. | 123/509 |

FOREIGN PATENT DOCUMENTS

| | | | | |
|---|---|---|---|---|
| DE | 10 2009 049 799 | A1 * | 4/2011 | F02M 37/00 |
| JP | 6-280708 | * | 10/1994 | F02M 37/12 |

* cited by examiner

*Primary Examiner* — Hai Huynh
(74) *Attorney, Agent, or Firm* — John A. Miller; Miller IP Group, PLC

(57) ABSTRACT

A fuel system for a vehicle engine. The fuel system includes a fuel vessel and a surge tank that is housed within the fuel vessel. One or more injectors inject fuel into the engine from the surge tank. The surge tank includes a lift pump that draws fuel from the fuel vessel into the surge tank. The fuel system also includes a connector line that connects the one or more injectors to the surge tank.

18 Claims, 5 Drawing Sheets

ANTI-SURGE TANK HOUSED WITHIN A FUEL VESSEL

BACKGROUND OF THE INVENTION

1. Field of the Invention

This invention relates generally to a fuel system that includes a surge tank and, more particularly, to a fuel system including a surge tank that is fully housed within a primary fuel tank of the fuel system.

2. Discussion of the Related Art

Most land vehicles, such as internal combustion engine vehicles, require a source of fuel, such as gasoline, that is stored on the vehicle generally within a fuel tank. A fuel pump pumps the fuel from the fuel tank to the vehicle engine where it is injected into the engine in a controlled manner. Certain situations, such as low fuel levels in the tank, may cause fuel starvation where the desired amount of fuel is not uniformly delivered from the fuel tank to the engine.

A surge tank (more precisely an "anti-surge tank") is a solution for fuel starvation that may occur during driving of a vehicle, particularly during spirited driving at low fuel levels. A surge tank functions by scavenging fuel from a fuel vessel, such as a primary fuel tank or a fuel cell, and then depositing the fuel in the surge tank, also known as a secondary reservoir. Fuel is drawn from the surge tank by the fuel system that uses the fuel for consumption by the engine. Surge tanks are often used in forced induction (turbocharged or supercharged) fuel systems to prevent the engine from being starved of fuel. During aggressive driving or harsh driving conditions, fuel is thrown from side to side in a fuel tank, which may cause a fuel pick up device to suck in air rather than fuel. Surge tanks minimize this problem by enabling the fuel pick up device to continuously suck up fuel. However, a surge tank is an additional component that must be added to the fuel system of a vehicle. Thus, there is a need in the market for a surge tank that is capable of being compactly included within the physical confines of the fuel system of a vehicle.

SUMMARY OF THE INVENTION

In accordance with the teachings of the present invention, a fuel system for a vehicle is disclosed. The fuel system includes a fuel vessel and a surge tank that is housed within the fuel vessel. One or more injectors inject fuel into the engine from the surge tank. The surge tank includes a lift pump that draws fuel from the fuel vessel into the surge tank. The fuel system also includes a connector line that connects the one or more injectors to the surge tank.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a fuel system including a surge tank is merely exemplary in nature, and is in no way intended to limit the invention or its applications or uses.

Figure 1:
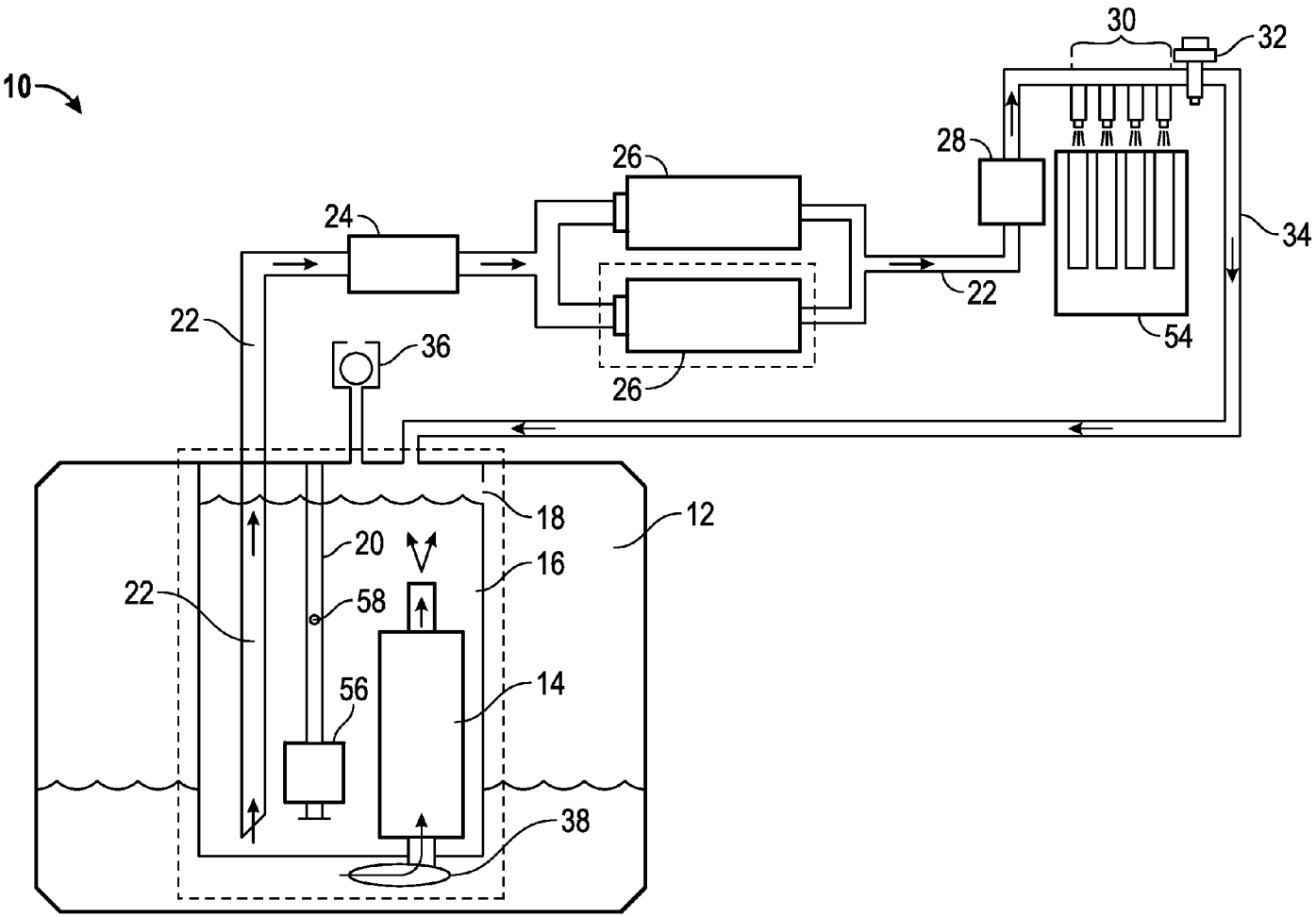
FIG. 1 is a schematic diagram of a fuel system with a surge tank in a primary fuel tank.

FIG. 1 is a schematic diagram of a fuel system 10 for a vehicle that includes an internal combustion engine 54. The fuel system 10 includes a fuel vessel 12, such as a primary fuel tank that stores fuel for the internal combustion engine 54. Alternatively, the fuel vessel 12 may be a fuel cell, such as a racing fuel cell. A surge tank 16 is fully housed within the fuel vessel 12 thereby avoiding the need to install or relocate additional components, as is discussed in more detail below. A filter sock 38 sits below the surge tank 16, as shown in more detail in FIG. 2. More specifically, the filter sock 38 sits below a bottom cap 80 of the surge tank 16 and the filter sock 38 filters fuel that is drawn up through the bottom cap 80 by a lift pump 14 that is inside the surge tank 16. The lift pump 14 may be one or more lift pumps. The lift pump 14 may be, for example, an industry-standard motorsport fuel pump. The flow rating of the lift pump 14 may be, for example, a flow rating that is able to support a minimum of 750 horsepower. The specific lift pump 14 that is used will depend on fuel consumption.

The lift pump 14 scavenges fuel from the vessel 12, as stated above, and fills a reservoir that is within the surge tank 16. The internal volume of the surge tank 16 may vary depending on the application. For example, an internal volume of 1.5 liters or more for the surge tank 16 may be used, depending on the expected rate of fuel flow needed and duration of high-G operation, such as when the vehicle is being driven around a long sweeping curve.

After the lift pump 14 fills the reservoir of the surge tank 16 with fuel, excess fuel that is pumped into the surge tank 16 spills through an overflow port 18 and back into the fuel vessel 12. Under normal operation, the surge tank 16 is constantly filled to the level of the overflow port 18. The location of the overflow port 18 may vary, depending on the optimal location of the port 18. For example, it may be beneficial to place the overflow port 18 at a location of the surge tank 16 that faces the front of the vehicle in which the surge tank 16 is installed to prevent excessive overflow of fuel from the surge tank 16 during acceleration of the vehicle.

A diagnostic probe assembly 20, discussed in detail below, extends down into the surge tank 16. Fuel is drawn from the surge tank 16 to the engine 54 through a supply line 22 that is in the surge tank 16 and extends out of the surge tank 16. Fuel from the surge tank 16 passes through a fuel filter 24 that is in the supply line 22 to one or more pressure pumps 26. Fuel exits the pressure pump(s) 26 and passes through a fine filter 28 that is in the supply line 22. After the fuel passes through the fine filter 28 it is available to an injector rail 30 that supplies fuel to the engine 54. Any unused fuel will pass by a fuel pressure regulator 32 on a return line 34 that returns unpressurized fuel to the surge tank 16. The return line 34 is not shown in FIG. 2 for the sake of clarity. A vent 36 equalizes internal tank pressure of the fuel vessel 12 with ambient pressure. The vent 36 may be included in the surge tank 16 if desired, as the pressure of the fuel vessel 12 and the surge tank 16 will be equalized via the overflow port 18.

The diagnostic probe assembly 20 continuously monitors fuel level and fuel temperature inside the surge tank 16. FIG.

3 is a block diagram of controls architecture 74 that illustrates how the diagnostic probe assembly 20 might function when used in conjunction with a programmable ECU. The diagnostic probe assembly 20 includes a fuel level switch 56 that provides a signal on fuel level line 40*a*/40*b* and a fuel temperature switch 58 that provides a fuel temperature signal on fuel temperature line 42*a*/42*b*. The signals from the lines 40*a*/40*b* and 42*a*/42*b* are inputs to an engine control unit (ECU) 44 that receives the signals from the fuel level line 40*a*/40*b* and the fuel temperature line 42*a*/42*b*. Under normal operating conditions, the surge tank 16 is full and the fuel level switch 56 is closed. The fuel level switch 56 will open if the fuel level within the surge tank 16 falls below a predetermined threshold. For example, the fuel level switch 56 may be calibrated such that a float will cause the fuel level switch 56 to open if the fuel level in the surge tank 16 falls below a predetermined threshold, such as 20% of the total volume of the surge tank 16.

If the fuel level falls below the predetermined threshold and the switch 56 is opened, a safety feature and/or safety procedure may be implemented because a low fuel level indicates that the consumption of the fuel system 10 is exceeding the fuel supply that is available within the surge tank 16, as provided by the lift pump 14. Safety features and/or safety procedures that may be used include, but are not limited to, using the ECU 44 to decrease boost to the engine 54, shown on line 46, increase injector pulse width to add fuel and thereby reduce combustion chamber temperatures, shown on line 50, retard ignition timing, shown on line 48, or other action to reduce the propensity to detonate. Whether temporary or long-term, low fuel may eventually lead to air being sucked into the supply line 22. Air in the supply line 22 will displace fuel in the fuel system 10, causing a lean condition in one or more combustion chambers of the engine 54 that could lead to loss of power, increased combustion temperatures and possibly damaging detonation.

The fuel temperature line 42*a*, 42*b* connects to a temperature switch 58 that is part of the diagnostic probe assembly 20. When the fuel temperature within the surge tank 16 exceeds a predetermined threshold, the fuel temperature sensor 58 will send a signal to the ECU 44 that will cause a safety feature to be triggered, such as those discussed above for low fuel level. High fuel temperatures, for example in excess of 120° F., will increase the propensity for fuel to cavitate or boil in a region of the fuel supply line 22 that is between the surge tank 16 and the pressure pump(s) 26. This phenomenon is exacerbated by the low pressure in the supply line 22 that is created by suction from the pressure pump(s) 26. If fuel boils, it may cause fuel mixture problems that are similar to those caused by low fuel levels. Thus, the chosen predetermined temperature threshold must be one that prevents cavitation.

Figure 4:
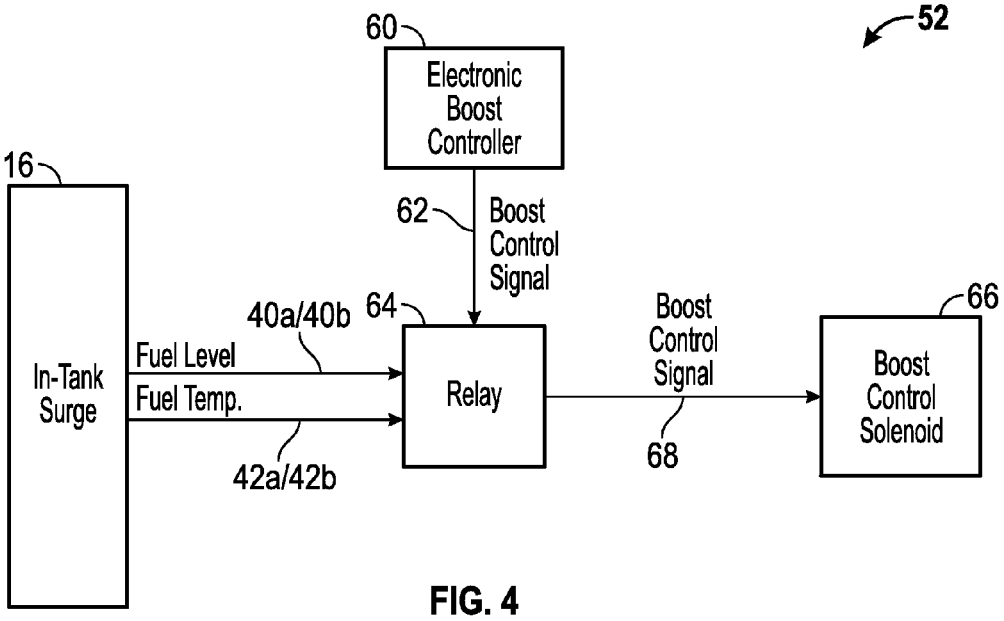
FIG. 4 is a block diagram of surge tank controls with an Electronic Boost Controller (EBC)

FIG. 4 is a block diagram of a control system 52 for a portion of the fuel system 10 that includes the surge tank 16 and an electronic boost controller (EBC) 60. The EBC 60 is a stand alone unit, i.e., is a unit that is typically divorced from the ECU 44, discussed above. The EBC 60 controls a boost control signal that is provided on line 62 through a relay 64 to a boost control solenoid 66. A control signal for the relay 64 is wired through the fuel level line 40*a*/40*b* and the fuel temperature signal line 42*a*/42*b* in series. According to this arrangement, the EBC 60 will operate normally as long as the fuel level switch signal from the line 40*a*/40*b* and the fuel temperature switch signal from the line 42*a*/42*b* are closed, i.e., the predetermined fault thresholds for each, discussed above, have not been achieved. If one or both of the switches are open, i.e., one or both of the predetermined thresholds discussed above are achieved, a fault is detected and the EBC 60 boost control signal will be interrupted by the relay 64. The result will be that the boost control signal on line 68 to the boost control solenoid 66 will default to the minimum level, which is defined by a physical spring in the wastegate, as is known to those skilled in the art. The boost control arrangement described above is an example of a typical aftermarket fail-safe arrangement, other arrangements may require different control strategies.

Figure 5:
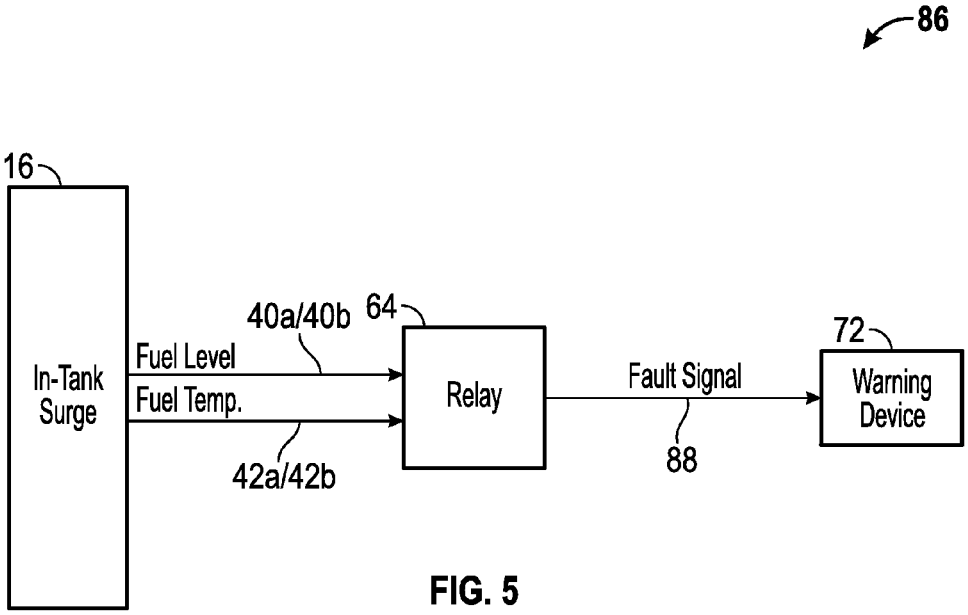
FIG. 5 is a block diagram of surge tank controls with a Warning Device.

FIG. 5 is a block diagram of a control system 86 for a portion of the fuel system 10 that includes the surge tank 16 and a warning device 72. If it is not feasible to control operation of the engine 54 in response to the fuel level or the fuel temperature threshold being achieved, a passive safety feature such as a warning light and/or a buzzer may be sent from the relay 64 to the warning device 72 on line 88. The signal for the passive safety feature originates from the fuel level line 40*a*/40*b* and/or the fuel temperature line 42*a*, 42*b* in parallel such that a fault in either of the lines 40*a*/40*b* or 42*a*/42*b* would close the appropriate switch and activate a warning feature.

The surge tank 16 may be made of aluminum or similar material that has high thermal conductivity so that heat is dissipated from the surge tank 16 to the surrounding fuel in the fuel vessel 12. This is particularly beneficial because high performance fuel pumps such as the one or more pressure pump(s) 26 may add a significant amount of heat to the fuel in the surge tank 16, which holds a limited volume of fuel. The immersion of the surge tank 16 within the fuel vessel 12 combined with the high thermal conductivity of aluminum minimize this issue by using the surrounding fuel to directly cool the contents of the surge tank 16. In contrast, known OEM fuel pump modules are typically plastic, which may have an insulating effect.

Providing the surge tank 16 within the fuel vessel 12 provides several other advantages, including improved occupant safety by keeping fuel out of the passenger compartment (external surge tanks are often mounted inside a vehicle cabin, which is less desirable and more dangerous). Other advantages of the fuel system 10 discussed above include: warning of impending fuel starvation to avoid lean conditions and potential engine damage, maintaining of OEM package (does not require additional spacing or mounting solutions), and preservation of OEM look (no visible sumps or tanks). As stated above, fuel in the surge tank 16 is kept cool by the surrounding fuel in the fuel vessel 12, and the surrounding fuel as well as the fuel vessel 12 serve to dampen noise and vibration from the lift pump 14. Also, plumbing that is associated with an external surge tank is eliminated using the fuel system 10 discussed above, and since key components are inside the fuel vessel 12, the risk of leaks is greatly reduced. Additionally, because of the mounting mechanism of the surge tank 16, discussed below, the surge tank 16 may be installed in a vehicle of any vintage, including vehicles that do not have an original/OEM fuel pump module.

Figure 2:
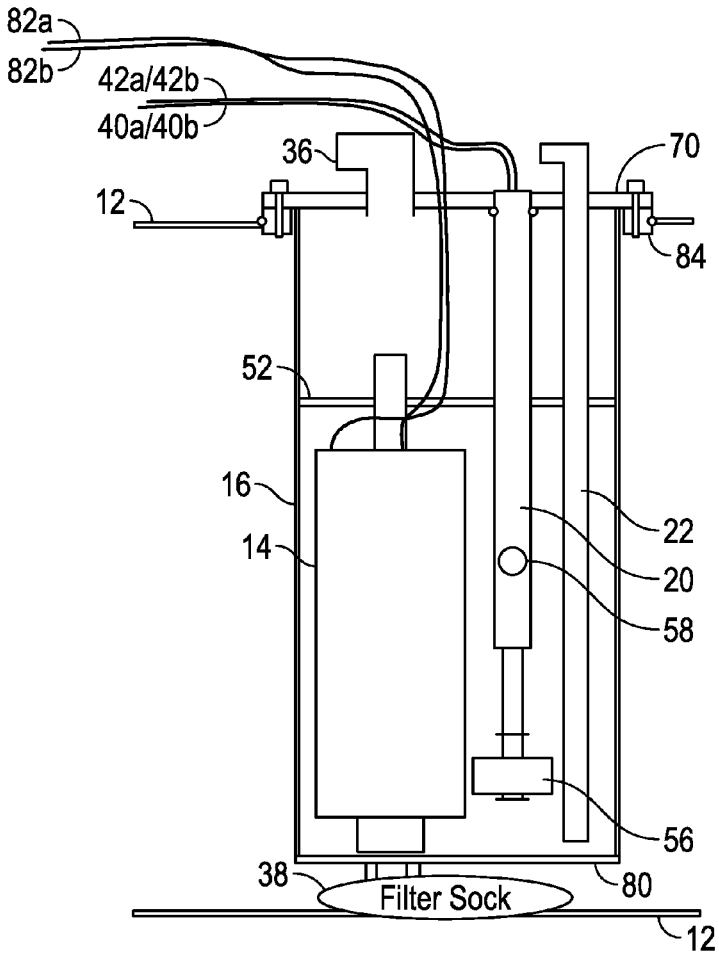
FIG. 2 is a cut-away view of the surge tank with a top cap and a bottom cap.
Figure 3:
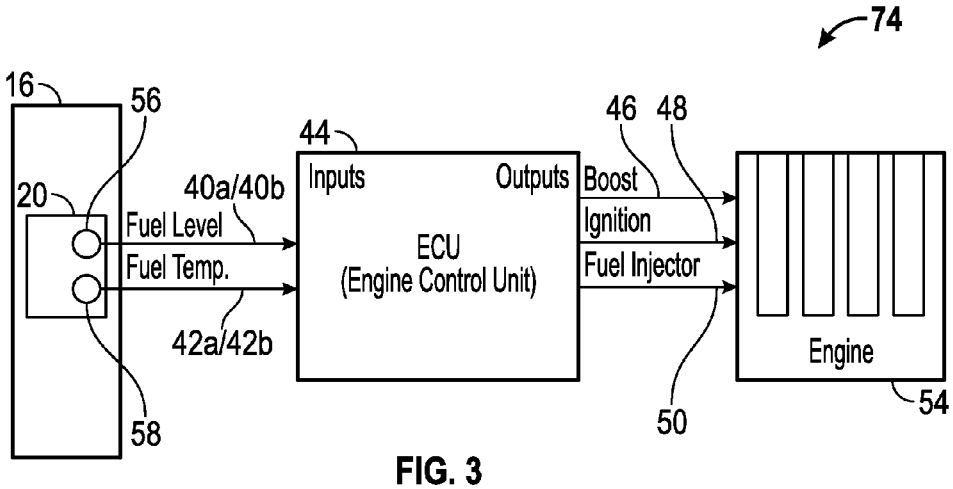
FIG. 3 is a block diagram of surge tank controls with a programmable Engine Control Unit (ECU)
Figure 6:
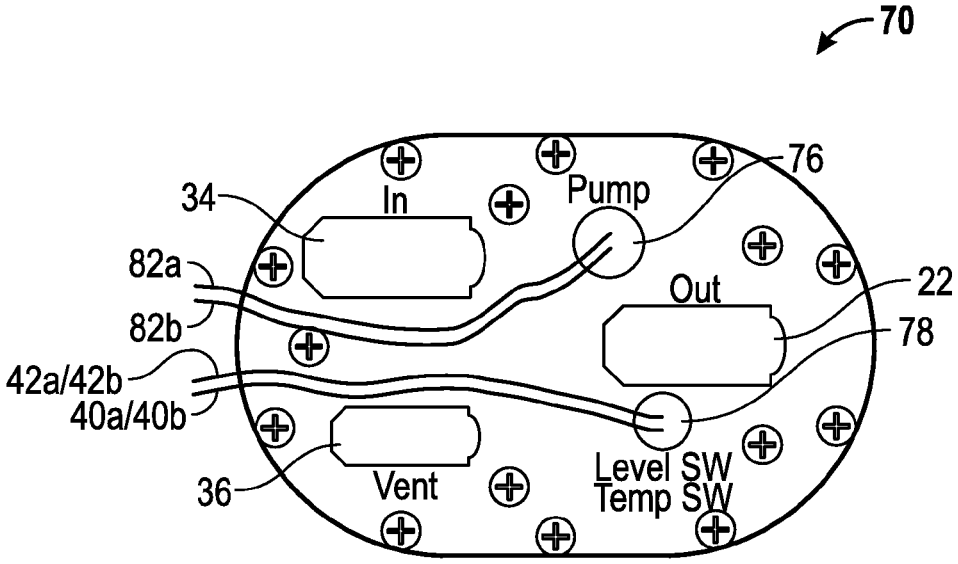
FIG. 6 is a top view of a top cap of a surge tank.

FIG. 6 is a top view of a surge tank top cap 70. The lines 40*a*/40*b* and 42*a*/42*b*, discussed above, are connected to the fuel level switch 56 and the fuel temperature switch 58, respectively, through a seal 78 that is fitted to the top cap 70. Lines 82*a*/82*b* are connected to the lift pump 14 through a seal 76 that is mounted to the top cap 70. The supply line 22 and the return line 34 pass through and are sealed to the top cap 70. As shown in FIG. 2, the surge tank 16 is affixed to the fuel vessel 12 via a mounting flange 84 that is affixed to the fuel vessel 12. The mounting flange 84 may be an OEM primary flange or a custom-designed piece that is affixed to the tank, so long as the surge tank 16 fits within the confines of the mounting flange 84. The top cap 70 is affixed to the flange 84 via screws, one or more sealing rings, and/or similar methods. One or more baffles 52 may be installed within the surge tank 16 as required to quell fuel slosh. The top cap 70 is made of any suitable material and is designed to seal a top portion of the surge tank 16 when the top cap 70 is affixed to the flange 84. As stated above, the top cap 70 includes a sealed fitting 76 for the lines 82*a*/82*b* of the lift pump 14 and a sealed fitting 78 for the diagnostic probe assembly 20. For example, approximately 3 feet of fuel pump wire with soldered eye terminals and sealed connectors may be included for the lines 82*a*/82*b* of the lift pump 84 and for the lines 40*a*/40*b* and 42*a*/42*b* of the diagnostic probe assembly 20.

Figure 7:
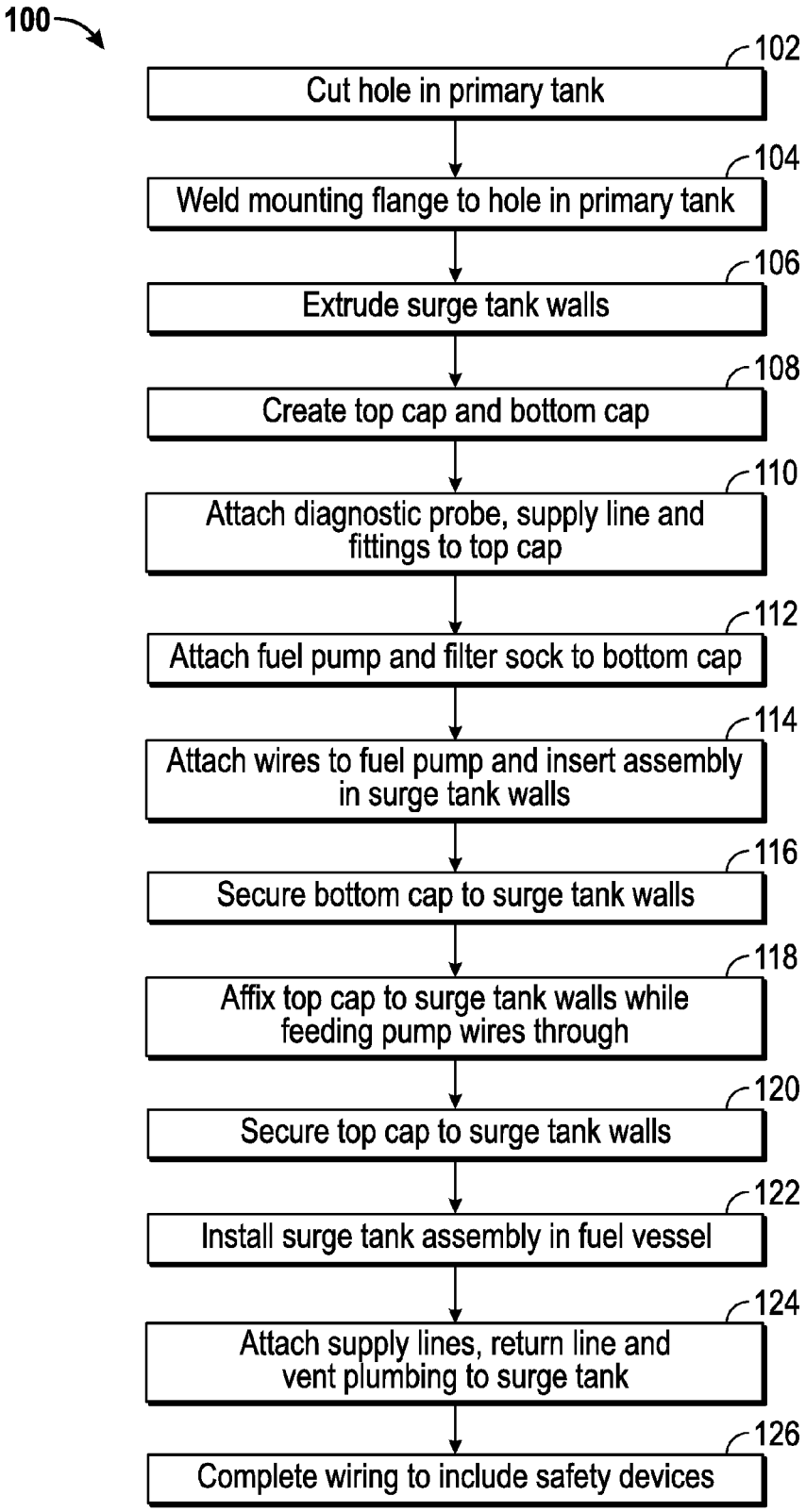
FIG. 7 is a flow diagram of a method for making a fuel system that includes a surge tank within a primary fuel tank.

FIG. 7 is a flow diagram 100 of a method for creating the fuel system 10 discussed above. In the case where the surge tank 16 will not fit through the OEM flange, i.e., the OEM access panel/ort on the fuel vessel 12, a hole is cut into a wall of the fuel vessel 12 at box 102. The size of the hole cut in the wall of the fuel vessel 12 depends on the desired circumference of the surge tank 16. By way of example, an approximately 4 inch by 6 inch diameter hole that is oval in shape may be cut. Next, the mounting flange 84 is attached to the hole cut in the fuel vessel 12 at box 104. Depending on the material the fuel vessel 12 is made of, the flange may be affixed by one or more of the following: metal weld, plastic weld, mechanical fasteners, and/or adhesive sealant. Next, the desired circumference and length of aluminum or similar material that is to be the walls of the surge tank 16 is formed. For example, the walls of the surge tank 16 may be formed via extrusion using known extrusion processes. Additionally, the walls of the surge tank 16 as well as the surge tank components discussed below, may be anodized to prevent corrosion and to allow for engraving on the components using known engraving techniques such as laser engraving.

Once the walls of the surge tank 16 are formed at the box 106, the top cap 70 and the bottom plate 80 for the surge tank 16 are created at box 108. The hole cut for the top cap 70 and the extruded surge tank walls may be any shape desired. For example, the walls may be oval, round, square, rectangular etc. Ideally, the walls are tall and narrow to minimize sloshing of the fuel within the surge tank 16. As stated above, the baffle 52 may be included to minimize fuel sloshing. The diagnostic probe assembly 20, supply line 22, and all fittings are attached to the top cap 70 at box 110. The lift pump or pumps 14 and the filter sock 38 are attached to the bottom cap 80 at box 112. Next, the wires that make up lines 82*a* and 82*b* are attached to the lift pump 14, and the bottom cap 80 with the wired lift pump 14 and the filter sock 38 are inserted inside the bottom portion of the extruded walls of the surge tank 16 at box 114. The bottom cap 80 is secured to the bottom portion of the surge tank 16 via screws at box 116.

The supply line 22 is positioned down into the extruded walls of the surge tank 16 along with the top cap 70 while the lines 82*a* and 82*b* for the lift pump 14 are fed out of the surge tank 16 through the top cap 70 at box 118. Next, the top cap 70 is secured to the top portion of the surge tank 16 via screws at box 120. The completed surge tank assembly is installed in the fuel vessel 12 by fastening to the mounting flange 84 at box 122. The supply line 22, the return line 34 and plumbing for the vent 36 are attached to the surge tank 16 and the fuel system 10 at box 124. Finally the wiring for the surge tank 16 is completed and connected to the safety devices discussed above at box 126.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A fuel system for a vehicle, said vehicle including an engine, said fuel system comprising:

a fuel vessel that stores fuel for the engine;

one or more injectors that inject fuel into the engine;

a surge tank that is housed within the fuel vessel, wherein the surge tank includes a lift pump that draws fuel from the fuel vessel into the surge tank;

a connector line connecting the one or more injectors to the surge tank; and a diagnostic assembly that is housed within the surge tank, said diagnostic assembly including a fuel level switch and a fuel temperature switch, wherein the fuel level switch is opened when a predetermined minimum fuel threshold has been reached and the fuel temperature switch is opened when a predetermined maximum fuel temperature has been reached.

2. The system according to claim 1 wherein the surge tank includes an overflow port that allows fuel that is in the surge tank to spill out into the fuel vessel.

3. The system according to claim 1 further comprising a warning light or buzzer that indicates when the fuel level switch is opened.

4. The system according to claim 1 further comprising a warning light or buzzer that indicates when the fuel temperature switch is opened.

5. The system according to claim 1 further comprising a controller that is programmed to implement a safety procedure if the fuel level switch or the fuel temperature switch is opened.

6. The system according to claim 5 wherein the safety procedure implemented includes decreasing boost to the engine, increasing injector pulse width, retarding ignition timing, or other action to reduce the likelihood of detonation.

7. A fuel system for a vehicle, said vehicle including an engine, said fuel system comprising:

a fuel vessel that stores fuel for the engine;

a plurality of injectors that inject fuel into the engine;

a surge tank that is housed within the fuel vessel, wherein the surge tank includes a lift pump that draws fuel from the fuel vessel into the surge tank;

a connector line connecting the plurality of injectors to the surge tank; and a diagnostic assembly that is housed within the surge tank, said diagnostic assembly including a fuel level switch and a fuel temperature switch, wherein the fuel level switch is opened when a predetermined minimum fuel threshold has been reached and the fuel temperature switch is opened when a predetermined maximum fuel temperature has been reached.

8. The system according to claim 7 wherein the surge tank includes an overflow port that allows fuel that is in the surge tank to spill out into the fuel vessel.

9. The system according to claim 7 further comprising a warning light or buzzer that indicates when the fuel level switch is opened.

10. The system according to claim 7 further comprising a warning light or buzzer that indicates when the fuel temperature switch is opened.

11. The system according to claim 7 further comprising a controller that is programmed to implement a safety procedure if the fuel level switch or the fuel temperature switch is opened.

12. The system according to claim 11 wherein the safety procedure implemented includes decreasing boost to the engine, increasing injector pulse width, retarding ignition timing or other action to reduce the likelihood of detonation.

13. A method for creating a surge tank for a fuel system in a vehicle, said method comprising:

providing a fuel vessel that stores fuel for an engine of the vehicle;

extruding surge tank walls, wherein the extruded surge tank walls are connected to a top cap and a bottom cap;

inserting the surge tank within the fuel vessel of the fuel system; and providing a diagnostic assembly that is housed within the surge tank and that includes a fuel level switch and a fuel temperature switch, wherein the fuel level switch is opened when a predetermined minimum fuel threshold has been reached and the fuel temperature switch is opened when a predetermined maximum fuel temperature has been reached.

14. The method according to claim 13 further comprising providing a connector line that connects one or more injectors to the surge tank, said one or more injectors providing fuel to the engine.

15. The method according to claim 13 wherein extruding the surge tank walls includes providing an overflow port that allows fuel that is in the surge tank to spill out into the fuel vessel.

16. The method according to claim 13 further comprising providing a warning light or buzzer that indicates when the fuel level switch is opened or the fuel temperature switch is opened.

17. The method according to claim 13 further comprising providing a boost controller that is programmed to implement a safety procedure if the fuel level switch or the fuel temperature switch is opened.

18. The method according to claim 17 wherein the safety procedure implemented includes decreasing boost to the engine, increasing injector pulse width, retarding ignition timing, or other action to reduce the likelihood of detonation.

* * * * *